United States Patent [19]

Garbark

[11] 4,360,203

[45] Nov. 23, 1982

[54] ROLLOVER SWITCH FOR PINBALL GAME

[75] Inventor: Roman F. Garbark, Westchester, Ill.

[73] Assignee: D. Gottlieb & Co., Northlake, Ill.

[21] Appl. No.: 184,784

[22] Filed: Sep. 8, 1980

[51] Int. Cl.[3] ..... A63F 7/00

[52] U.S. Cl. ..... 273/121 A; 200/61.11

[58] Field of Search ..... 200/61.1, 61.11, 159 B, 200/329, 330, 335, DIG. 29; 273/118 A, 119 A, 121 A, 122 A, 41

[56] References Cited

U.S. PATENT DOCUMENTS

| | | | |
|---|---|---|---|
| 2,184,866 | 12/1939 | Rabtke | 273/121 A |
| 2,191,209 | 2/1940 | Hooker | 273/121 A |
| 2,253,796 | 8/1941 | Livingston | 200/61.11 |
| 2,547,164 | 4/1951 | Lemke | 200/61.11 |
| 2,610,277 | 9/1952 | Hooker et al. | 200/61.11 |
| 3,608,903 | 9/1971 | Cooper et al. | 273/1 R |
| 3,978,297 | 8/1976 | Lynn et al. | 200/159 B |
| 4,180,267 | 12/1979 | Harrop | 273/118 A |

*Primary Examiner*—Vance Y. Hum
*Assistant Examiner*—Leo P. Picard
*Attorney, Agent, or Firm*—Arnold, White & Durkee

[57] ABSTRACT

A rollover switch for pinball game includes a yieldable, and preferably elastic surface deformable between a position substantially level with the playfield surface and a position above the playfield surface. In one embodiment, the elastic surface is defined by a plurality of members connected by a hinge to support structure. The support structure defines a periphery, and the members extend inwardly from the hinged periphery. A plunger is provided to engage switch contacts as the members are advanced about the hinged connection. In another embodiment, the elastic surface is defined by a stretchable membrane which is deformable between a position substantially flush with the surface of the playfield and a position above the playfield.

43 Claims, 10 Drawing Figures

Fig. 4
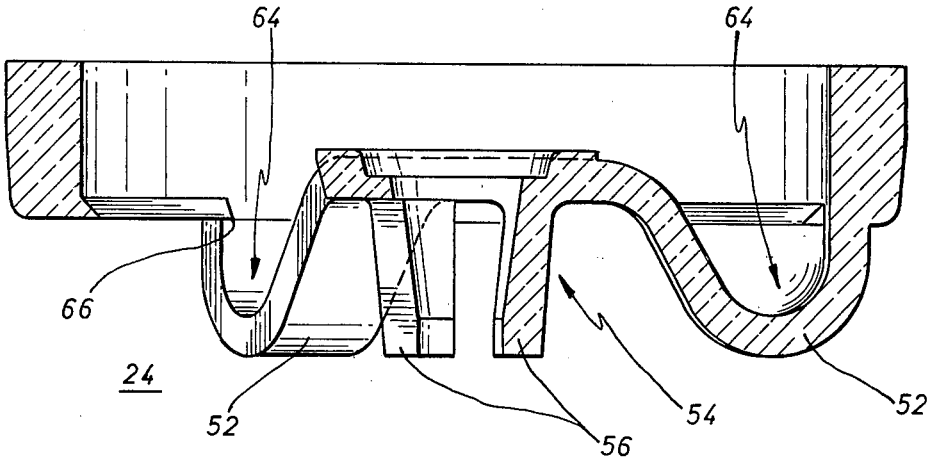
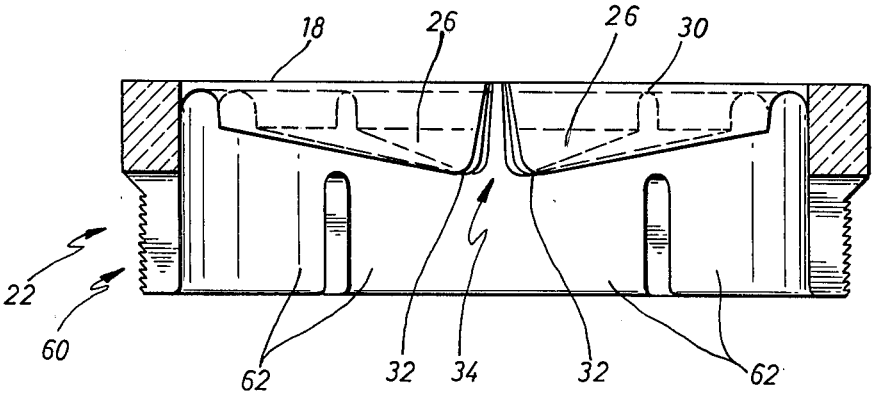
Fig. 5
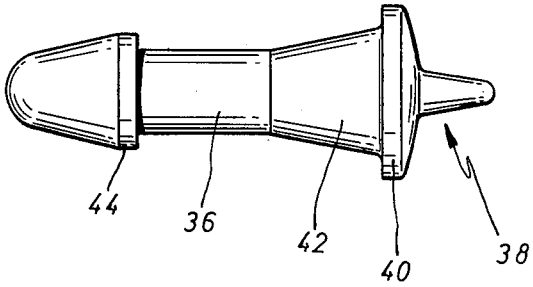
Fig. 6

ROLLOVER SWITCH FOR PINBALL GAME

BACKGROUND OF THE INVENTION

This invention relates in general to pinball game machines and more specifically relates to ball actuable rollover switches for pinball games.

In pinball games, rollover switches are occasionally employed as play features used to promote player interest and game attractiveness. A rollover switch is a device supported on the playfield in a position generally to allow the ball to roll over it. As the ball rolls over the switch, the ball initiates movement of an element which actuates switch contacts.

Two types of rollover switches presently employed in pinball games are the star rollover switch and the button rollover switch. In both of these types of switches, a plunger mechanism is connected to be ball actuated for engaging the switch contacts. In the star-rollover configuration, projections on the end of the plunger extend through slots in a flat plate mounted flush with the playfield surface. As the ball rolls over the flat plate, it depresses the projections and thus the plunger to actuate the switch. The projections are shaped to extend radially at a downward taper from an elevated center. This is an attempt to minimize deflection of the ball upon its engagement with the projections. In the button switch, a relatively flat button-type surface extends slightly above the playfield such that ball engagement with the surface pushes its plunger downwardly to engage the switch contacts. The button is movably mounted on the plunger in an attempt to minimize ball deflection.

Prior art rollover switches are believed to have suffered from disadvantages. The slots in the plate for the star rollover switch occasionally become clogged during manufacture and assembly. Neither the star rollover switch nor the button rollover switch has achieved optimization of minimizing the amount of ball deflection upon its engagement with the rollover switch. And, neither has obtained the optimum sensitivity in recording a rollover when the ball does not pass precisely over the center of the rollover switch.

SUMMARY OF THE INVENTION

The above noted and other drawbacks of the prior art are believed overcome by the present invention in providing a rollover switch for a pinball game which features a surface which is yieldable when a ball passes over it. The yieldable surface is preferably elastic to provide a restoring force and is deformable from a substantially flat configuration flush with the pinball playfield surface to a raised configuration tapered downwardly from an elevated central region to the playfield surface. The rollover switch of the present invention is modular and may be inserted into the playfield after completed manufacture of the playfield, thereby eliminating problems of contamination. The present invention also is designed to minimize ball deflection upon ball engagement therewith by yieldably connecting the elastic surface to the pinball playfield at locations around the periphery of the elastic surface.

According to one aspect of the present invention, a rollover switch for a playfield surface of a pinball game includes a yieldable surface which is adapted to be supported by the pinball game playfield. The yieldable surface defines a surface region which is movable upon ball engagement from a first position to a second position. A detector is provided for detecting the surface region travelling to the second position in response to ball actuation.

According to another aspect of the invention, the yieldable surface of the rollover switch is defined by the member to have a first shape in the absence of ball engagement and to have a second shape upon ball engagement. The changing of the shapes due to ball engagement causes the surface region to travel a detectable difference. The detector includes at least one contact of a set of electrical contacts for detecting when the surface region has travelled the distance. Preferably, the second shape, and the shape of the member when the surface region is in the second position, is substantially flat such that the surface is substantially flush with the playfield surface.

According to another aspect of the present invention, a ball actuable rollover switch for a playfield of a pinball game includes support structure adapted to be supported with respect to the surface of the pinball game playfield for defining an elastic surface. The elastic surface is deformable between positions above and substantially level with the playfield surface. A set of switch contacts is disposed with respect to the elastic surface to be actuated when the elastic surface deforms between the positions due to ball engagement therewith.

The support structure in one embodiment is comprised of a plurality of members movably interconnected to define the elastic surface. In another embodiment, the elastic surface is comprised of a stretchable membrane. In both embodiments, a movably supported plunger is preferably provided to activate the switch contacts and to deform the elastic surface from the substantially playfield surface level position upwardly to an elevated position. In this elevated position, a central region is of the highest elevation and the elastic surface tapers downwardly to the playfield surface. This minimizes ball deflection upon ball actuation of the rollover switch.

The invention further includes a light source disposed for illuminating the elastic surface, thereby promoting player attraction.

In the embodiment wherein the elastic surface includes a plurality of interconnected members, a plurality of hinges, preferably living hinges, connect the members to peripheral support structure. The members are free to rotate about the hinge in response to movement of the plunger to provide the relatively flat surface and the elevated central region.

In this embodiment, a more detailed feature of the invention includes the provision of a shaped end for commonly engaging all the ends of the members opposite the hinge connections. The shaped end fills the space necessary between the ends of the members to allow movement of the members upwardly into the elevated position. The shaped end also serves as a guide for the members upon ball engagement therewith.

According to another aspect of the invention, a ball rollover device for a pinball game machine includes support structure adapted to be supported by the pinball game playfield. A plurality of surface-defining members extend outwardly from a central region to respective peripheral areas. Connectors, such as hinges, flexibly couple the respective surface-defining members to the support structure at the peripheral areas. This allows the plurality of surface-defining members to be movable with respect to each other to define an overall surface which is deformable to provide substantially flat and substantially pyramidal shapes.

In this embodiment, the support structure, the surface-defining members, and the connectors preferably are unitary and the surface-defining members are preferably comprised of a translucent plastic. In this embodiment, a plunger is movably supported between the movable members and a set of switch contacts for actuating the contacts and for urging the surface-defining members into the substantially pyramidal surface configuration. A light source is also preferably provided to eliminate the surface-defining members.

According to yet a more detailed version of the invention, the support structure includes first and second supports. The first support is adapted to be supported by the playfield, and the second support supports the surface-defining members. The first and second supports are respectively of greater and lesser peripheral dimensions to allow the second support to fit into or nest into the first support. The second support preferably includes serrated edges adapted to snap fit the second support into the first support.

It is accordingly a general object of the present invention to provide a new and improved rollover switch for a pinball game which employs a deformable elastic surface.

The above noted and other features and advantages of the invention will be more apparent when reading a detailed description of a preferred embodiment in conjunction with the drawings.

BRIEF DESCRIPTION OF THE DRAWINGS

FIGS. 4 and 5 are cross-sectional views of structure of the rollover switch of FIG. 1;

FIG. 6 is a plan view of a plunger employed in the rollover switch of FIG. 1.

DETAILED DESCRIPTION OF A PREFERRED EMBODIMENT

Figure 2:
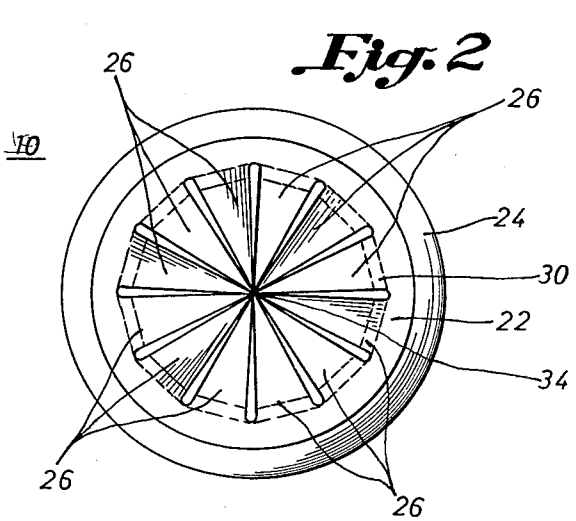
FIGS. 2 and 3 respectively are top and bottom views of the rollover switch of FIG. 1.
Figure 3:
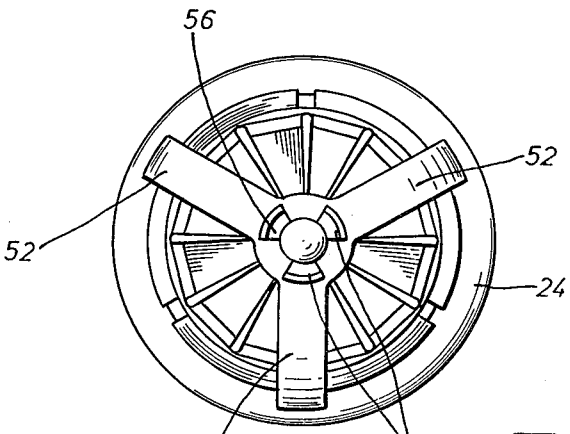

Referring now to FIGS. 1–3, a new and improved roll-over switch 10 is shown supported within the surface 12 of a pinball game machine playfield 14. The switch 10 includes a support structure 16 for supporting surface 18 which is yieldable to the ball as it rolls over the surface. The support structure 16 is fitted into an appropriate opening in the playfield 14 so that when inserted, its uppermost side is flush with the playfield surface 12.

In the preferred and illustrated embodiment, the yieldable surface 18 is elastic. As used herein, the term yieldable is defined to mean movable, and the term elastic is defined to mean capable of recovering shape and/or size upon having yielded. For example, if the surface 18 yields due to the ball engaging or rolling over it, it need not have an internal restoring force acting to restore the surface to the non-yielded state. However, an elastic surface, upon yielding or deformation, features a restoring force to recover either or both size and shape to resume substantially the size and shape prior to ball engagement.

Figure 1A:
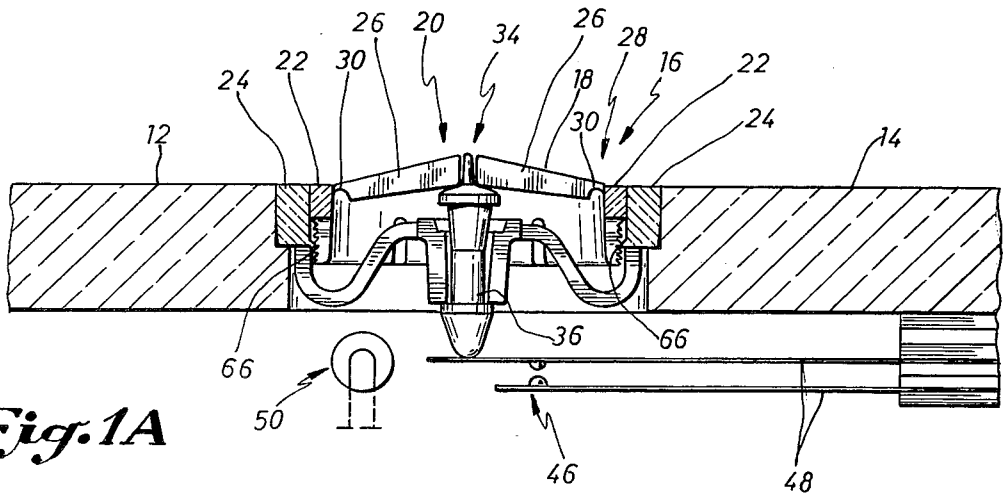
FIGS. 1*a* and 1*b* are cross-sectional plan views of a rollover switch according to one embodiment of the invention.
Figure 1B:
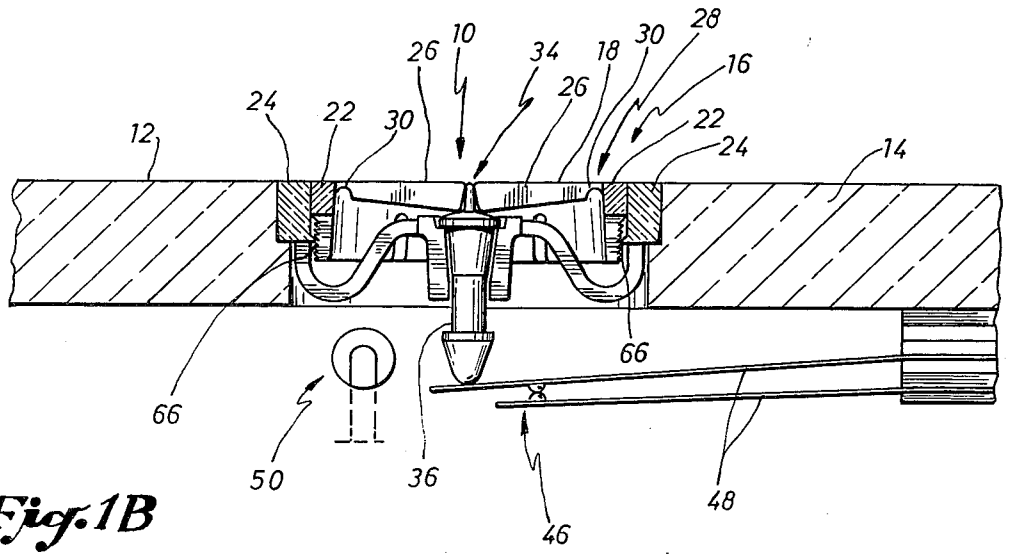

The elastic surface 18 is deformable between a first position flush or level with the playfield surface 12 as shown in FIG. 1*b* to a second, elevated position as shown in FIG. 1*c*. In the elevated position, the elastic surface 18 defines a central elevated region 20 from which the surface 18 slopes downwardly to the support structure 16 at the level of the playfield surface 12.

Whether in the playfield-level or elevated positions, the elastic surface 18 joins or is connected with the support structure 16 at the playfield surface level so that there is a minimum of ball deflection when it rolls over or engages the elastic surface 18. When in the playfield-level position, the elastic surface 18 provides a substantially continuous surface flush with the playfield surface 12 for minimizing ball deflection.

In a first preferred embodiment, the support structure 16 includes an inner support 22 and an outer support 24, and the elastic surface 18 is defined by a plurality of members 26. The outer support 24 press fits into an opening of appropriate size in the playfield 14. The inner support 22 and the outer support 24 are shaped and configured to allow the inner support 22 to nest with, and be inserted into, the outer support 24. The inner support 22 is press fitted into the outer support 24 a distance to enable it to have its upper most surface flush with the playfield surface 12.

Each of the members 26 is coupled to the inner support 22 by a connector 28. In the first preferred and illustrated embodiment, the connector 28 takes the form of a hinge 30. As seen in FIG. 5, the preferred embodiment features the inner support 22, the members 26, and the hinge 30 to be unitary; i.e., to be of a single piece construction. In this configuration, it is preferred that the single piece be of a translucent polypropylene, such as commercially available from Eastman Chemical Products, Inc., Plastic Division, Kingsport, Tenn. Dimensions for the unitary piece as shown in FIG. 5 are of the designer's choice; the invention provides freedom in the selection of the size and shape of the implementary parts.

In the unitary piece embodiment, the hinge 30 is of the type commonly referred to as a living hinge. The living hinge is of a sufficiently thin thickness and radius to allow the members 26 to rotate about the hinge 30 into the elevated and flush positions shown in FIGS. 1*a* and 1*b* respectively. Although this dimension is merely one of designer's choice, a preferred range of thickness for the state-of-the-art as presently understood in injection molding is 0.008 to 0.015 inches, and the preferred thickness is the smallest; i.e., 0.008 inches. A preferred radius is 1/32 inch.

Other non-unitary constructions are suitably within the invention, as are other materials, including plastics and metals exhibiting the necessary characteristic of yield-ability and/or elasticity.

As seen in FIG. 2, the members 26 are triangular or pie-shaped in a plan view. When viewed in elevation as in FIG. 5, the members 26 are of a size which increases in depth from the hinge 30 to the distant end 32. This configuration defines a space 34 between the ends 32 of the members 26. The space 34, as viewed in elevational, is of a triangular shape as seen in FIG. 5 when the surface 18 is in the playfield surface level position, and the space 34 becomes substantially parallel when the members are rotated about the hinge 30 to define the elevated surface position.

Referring now to FIGS. 1 and 6, the preferred and illustrated embodiment of the rollover switch 10 includes a plunger 36 movably supported by the outer support 24 for rotating the members 26 about their respective hinges 30. The plunger 36 includes an end portion 38 which is configured to fit into and fill the space 34. Accordingly, the end portion 38 is of a substantially cylindrical shape to fit the substantially parallel space 34 when the members are in the elevated position. The end portion 38 is of a length corresponding to the depth of the members 26 so that the end of the end portion 38 is adjacent the end 32 of the respective members 26. The plunger 36 defines a shoulder 40 from which the end portion 38 extends. The ends of the members 26 commonly rest on the shoulder 40.

The plunger 36 further defines a central cylindrical bearing surface 42 and a lower shoulder 44. The shoulder 44 is of a slightly decreased diameter than the shoulder 40 as will be explained. The bearing surface 42 is of a length sufficient to allow full travel of the surface region 20 because of ball engagement with the surface 18.

As seen in FIGS. 1*a* and 1*b*, a detector is provided for detecting the travel of the plunger 36 and thus of the surface region 20. In the illustrated embodiment the detector comprises at least one electrical contact and preferably comprises a set of electrical contacts 46 provided on supporting members 48. The electrical contacts 46 are disposed with respect to the surface 18 such that rotation of the members 26 about their respective hinges 30 causes opening and closing of the contacts 46. Specifically, the contacts 46 are disposed sufficiently close to the end of the lower shoulder 44 such that when the members 26 are in the playfield-level position, the plunger 36 has traveled to its lower position, closing the contacts. When the members 26 are rotated upwardly to the above-playfield level position, the lower shoulder 44 travels upwardly to allow opening of the contacts 46.

In the preferred and illustrated embodiment wherein the support 22, the hinges 30, and the members 26 are unitary, the preferred method of constructing the unitary piece is by injection molding of polypropylene. During the molding process, it is preferred that the hinges be formed such that the natural or rest state of the hinges 30 and the members 26 is in the playfield-level position. Thus, an upward force directed against the plunger 36 is necessary in order to rotate the members 26 upwardly about the hinge 30. In the preferred and illustrated embodiment, this force is provided by the moment of the bending strength of the supporting members 48. It will be apparent that the amount of upward force provided by the members 48 is sufficient to overcome the tendency of the injected molded hinges 30 to keep the members 26 in the rest position, but is less than the weight of a ball on the playfield surface 12 rolling onto the elastic surface 18. Thus, upon the ball engaging the surface 18 (the members 26) to force the plunger 36 downwardly for closing the contacts 46, the natural restoring force of the hinges 30 and gravity lowers the remaining members 26 to the playfield-level position.

It will be appreciated that other methods and apparatus could be employed to raise the members 26 to the above-playfield level position. For example, the molding process could be designed to result in an above-playfield rest position for the members 26. In this event, the spring strength of the members 48 would raise the plunger 36 without additionally having to raise the members 26.

Yet other suitable modifications include the use of a separate spring mechanism, such as a coil spring surrounding the bearing surface 36 or a separate leaf spring adjacent the supporting members 48, rather than relying upon the natural spring strength of the supporting members 48.

As seen in FIG. 1*b*, a light source 50 is advantageously provided in proximity to the members 26. In the preferred embodiment, the members 26 are translucent so that light passing through the member 26 (i.e., through the surface 18) promotes player attraction, especially when the elastic surface 18 is decorated to promote player appeal. The light source 50 may be connected to be energized when the electrical contacts 46 are actuated.

Referring now to FIGS. 3 and 4, the outer support 24 is shown in more detail. The outer support 24 includes a set of arms 52 and a guide structure 54. Preferably, the support 24 is also unitary and is manufactured by the injection molding of a plastic such as Lexan, a product of General Electric Company, Plastic Sales Department, Pittsfield, Mass. In this configuration, the arms 52 and guide structure 54 are transparent for maximum attractiveness of the overall device.

The arms 52 define the guide structure 54 to be underlying the space 34. The inside dimension of the guide structure 54 is conformed to the dimension of the bearing surface 42 of the plunger 36.

The guide structure 54 is defined by a plurality of arms 56 extending downwardly from the junction of the arms 52. The arms 56 are of a sufficient flexibility to allow the lower shoulder 44 of the plunger 36 to be forcefully passed through it during initial assembly. The length of the arms 56 is selected in coordination with the length of the bearing surface 42 to allow sufficient travel of the plunger 36 for actuating the contacts 46 upon rotation of the members 26 as described.

As a more detailed feature of the invention, the inner support 22 and the outer support 24 are configured in a special snap-fit design. To this end (referring to FIGS. 1*b*, 4 and 5) the inner support 22 includes a portion 60 comprising a plurality of tabs 62. The tabs 62 have serrated edges and are of an outside dimension to fit within the outer support 24.

To receive the tabs 62, the arms 52 of the support 24 are curved to define a space 64 underlying a projection 66. The projection 66 extends around the inside dimension of the support 24 for engaging the serrated edges of the tabs 62 when the inner support 22 is inserted. The spacing between projections 66 opposite one another about the arms 56 are of a slightly reduced dimension than the diameter of the tabs 62 so that the projections 66 pressure the tabs 62 inwardly as they are inserted. The serrated edges of the tabs 66 are in a direction towards the surface 18 to allow insertion and to resist withdrawal due to their engagement with the projection 66. When desired, the inside support 22 can be removed from the outer support 24 via an appropriate tool which pulls the tabs 62 inwardly to separate the serrated edges and the projection 66.

Figure 9:
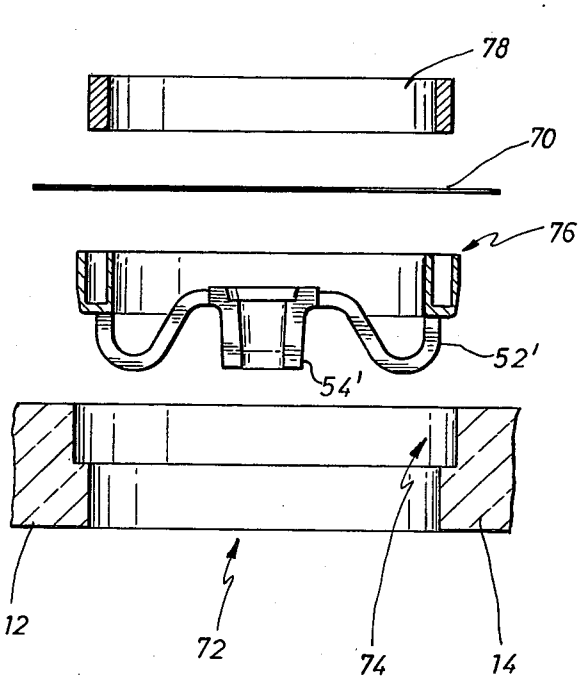
Figure 8:
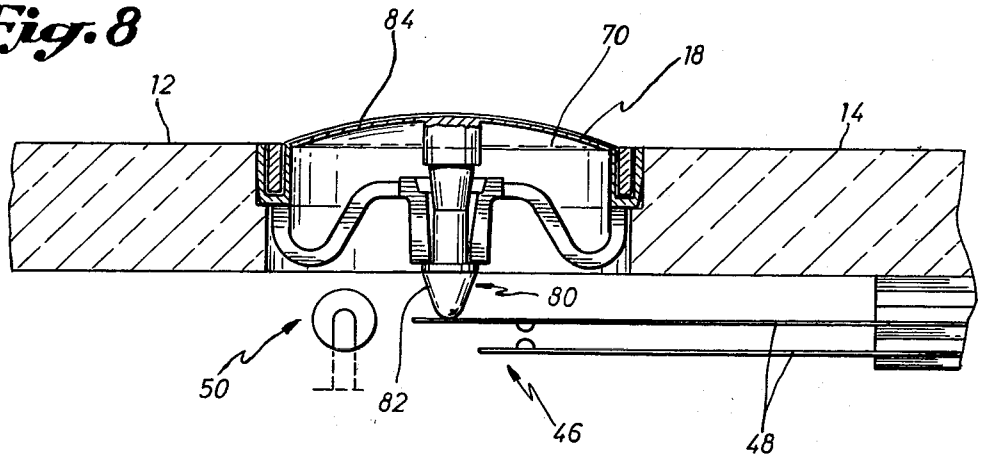
FIGS. 7 and 8 are views of an alternative rollover switch according to the invention employing a stretchable membrane.
Figure 7:
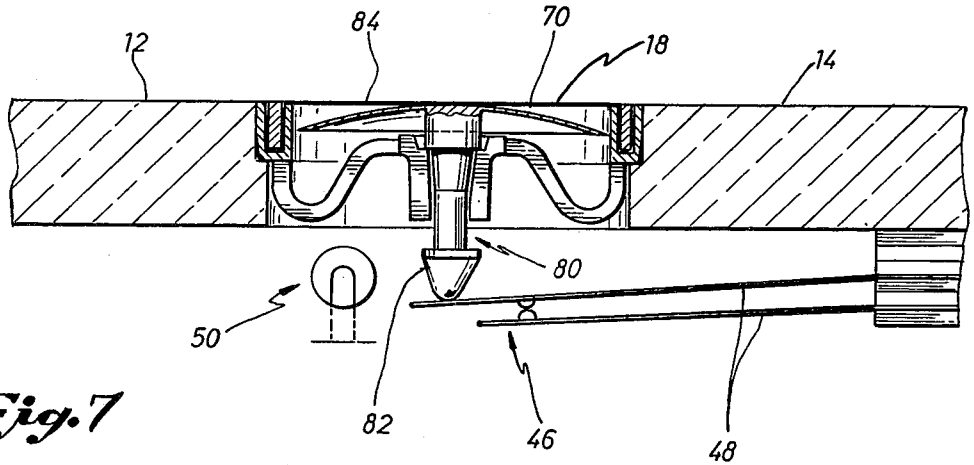

Referring now to FIGS. 7–9, an embodiment is shown wherein the elastic surface 18 is comprised of a stretchable membrane 70. The membrane 70 is preferably comprised of a rubber, such as Neopreme, as sold by DuPont Corporation.

In this embodiment, the playfield 14 defines a notched aperture 72. A notch 74 extends around the perimeter of the aperture 72 for receiving a U-shaped outer support 76. Cross-sectional dimensions of the outer support 76 is such to receive an inner support 78 pressed there into.

The outer support 76 is configured with arms 52' similar to the arms 52 to define guide structure 54' and arms (not shown) similar to the guide structure 54 and arms 56. The arms and guide structure 54' provide support and guidance for a movable plunger 80.

The plunger 80 includes a stem 82 and an upper portion 84. The upper portion 84 is curved in an umbrella shape and is of a cross-sectional dimension similar to that of the inside dimension of the outer support 76. As with the earlier-described embodiment, a set of electrical contacts 46 are provided adjacent the stem 82 to advance the plunger 80 upwardly in the absence of a ball on the membrane 70 and to be closed by the downward motion of the plunger 80 upon the presence of a ball on the membrane 70.

The plunger 80 and the membrane 70 are translucent and, along with the light source, 50, accomplish the same player attraction features as described in connection with the first embodiment.

It thus will be appreciated that in both embodiments, wherein the elastic surface 18 is comprised of a plurality of the members 26 and is comprised of the membrane 70, a new and improved rollover switch has been described which minimizes the amount of ball deflection while providing ample support for the ball as it rolls over the switch. In neither embodiment does the plunger mechanism, which actuates the electrical contacts, protrude above the elastic surface 18 for making direct engagement with the ball. And, in both embodiments, manufacturing of the rollover switch and its assembly into the pinball game playfield is facilitated.

Although the invention has been described in its preferred forms with a certain degree of particularity, it is understood that the present disclosure has been made only by way of example. For example, as long as the ball-engaged position or shape of the surface 18 is substantially flat at substantially the level of the playfield surface, the ball will not materially be deflected during rollover; thus, it is within the invention to have the surface region 20 travel a detectable distance below the level of the playfield surface as long as the travel does not materially impede the ball or materially alter the ball path. Numerous other changes in the details and construction of the combination and arrangement of parts will be apparent without departing from the spirit and the scope of the invention.

What is claimed is:

1. A ball actuated rollover switch for a shaped opening in a playfield of a pinball game, comprising:

(a) a plurality of yieldable surface-defining members which define the yieldable surface to be deformable between first and second shapes upon ball engagement with said surface, thereby to provide a surface region which travels in a direction substantially normal to the playfield a detectable distance upon ball engagement with said surface;

(b) structure configured to fit into said shaped opening for firmly supporting the periphery of said members at the level of the playfield ; and (c) a detector disposed with respect to said surface for detecting said surface region travelling said detectable distance.

2. A ball actuable rollover switch for a shaped opening in a playfield of a pinball game, comprising:

(a) a plurality of yieldable surface-defining members which define the yieldable surface to have a surface region movable in a direction substantially normal to the playfield between a first non-ball engaged position to a second ball engaged position, said second ball engaged position being substantially level with the playfield surface to thereby minimize ball deflection upon such engagement;

(b) structure configured to fit into said shaped opening for firmly supporting the periphery of said members at the level of the playfield; and (c) a detector disposed with respect to said surface for detecting said surface region moving to said second position.

3. The switch according to claim 1 wherein said ball engagement shape is a substantially planar shape substantially level with the playfield surface.

4. The switch according to claim 1 wherein said first shape is defined by said surface region elevated above said playfield and said second shape is a substantially planar shape substantially level with said playfield.

5. The switch according to claims 1 or 2 wherein said detector includes at least one electrical switch contact.

6. The switch according to claim 1 wherein said members are resiliently deformable to thereby return said surface region to said first shape after ball engagement with said surface.

7. The switch according to claim 1 wherein said members are resiliently deformable to thereby return said surface region to said first position after ball engagement with said surface.

8. A ball actuable rollover switch for a shaped opening in a playfield of a pinball game, comprising:

(a) means, including a plurality of members, adapted to be supported with respect to the surface of the pinball game playfield for defining a yieldable surface deformable to provide a surface region movable in a direction substantially normal to the playfield between a position not substantially level with the playfield surface and a position substantially level with the playfield surface;

(b) structure configured to fit into said shaped opening for firmly supporting the periphery of said yieldable surface at the level of said playfield; and (c) a set of switch contacts disposed with respect to said surface-defining means to be actuated thereby when the region moves between said positions due to ball engagement with the yieldable surface.

9. The rollover switch according to claim 8 wherein said surface-defining means is translucent.

10. The rollover switch according to claim 9 and further including a light source disposed for illuminating the surface-defining means.

11. The rollover device according to claim 10 wherein said plastic is translucent.

12. The rollover switch according to claim 8 and including means for urging the yieldable surface-defining means into the non-surface level position.

13. The rollover switch according to claim 8 and including means for urging the yieldable surface-defining means into the non-surface level position with a force of a value which allows ball engagement with the elastic surface to urge the yieldable surface to the surface-level position.

14. The rollover switch according to claim 8 wherein said yieldable surface-defining means comprises a support and a plurality of members connected to the support such that the non-level playfield position defines an overall surface which tapers therefrom toward the playfield surface.

15. The rollover switch according to claim 13 and including a plurality of hinges connecting said members to said support.

16. The rollover switch according to claim 8 wherein said surface-defining means comprises a plurality of hingedly connected members which define said yieldable surface.

17. The roll-over switch according to claim 8 and including a plunger commonly engageable with said members for actuating the switch contacts in response to the surface deforming between said positions.

18. The rollover switch according to claim 16 wherein said plunger includes means for commonly engaging the ends of the members opposite the hinge connections.

19. The rollover switch according to claim 8 and including a plunger for actuating the switch contacts in response to the surface deforming between said positions.

20. The rollover switch according to claim 8 wherein said surface-defining means is elastic, thereby to return said surface region to said non-substantially level position.

21. A ball rollover device for pinball game machine comprising:

(a) support structure adapted to be supported by the pinball game playfield;

(b) a plurality of surface-defining members extending outwardly from a central region to respective peripheral areas; and (c) means movably connecting the respective surface-defining members to said support structure at the peripheral areas, whereby the plurality of surface-defining members are movable with respect to each other to define an overall elastic surface which is deformable to provide substantially flat and substantially pyramidal shapes; said connecting means being configured to allow said surface defining members to move in response to ball engagement therewith.

22. The rollover device according to claim 20 wherein said support structure, said surface-defining members, and said connecting means are unitary.

23. The rollover device according to claim 20 wherein said surface-defining members are formed of plastic.

24. The rollover device according to claim 20 and including:

(a) a set of switch contacts; and (b) a plunger movably supported between said contacts and said support structure for urging the surface-defining members into the substantially pyramidal surface configuration.

25. The rollover device according to claim 20 wherein said connecting means is a hinge.

26. The rollover device according to claim 20 and including a plunger movably supported by the support structure for advancing the members to define the pyramidal shape.

27. The rollover device according to claim 20 wherein said support structure includes first structure adapted to be supported by the playfield and second structure for supporting said members, said first and second structures being respectively of greater and lesser peripheral dimensions to allow the second structure to fit inside the first structure, said second structure including serrated edges adapted to snap-fit and retain the second structure into the first structure.

28. A rollover switch for actuating a detector which includes at least one contact of a set of electrical contacts for a pinball game machine, comprising:

(a) support structure adapted to be supported by the pinball game playfield;

(b) means, including a plurality of movably supported members, defining an elastic surface deformable between first and second positions;

(c) means connecting the surface-defining means to the support structure; and (d) means disposed between the elastic surface-defining means and the detector to effect actuation of the electrical contacts in response to the elastic surface deforming between the first and second positions.

29. The rollover switch according to claim 28 wherein the movable means comprises a plunger movably supported between the electrical contacts and the surface-defining means.

30. The rollover switch according to claim 28 wherein the surface-defining means is translucent.

31. The rollover switch according to claim 28 wherein the connecting means includes a hinge.

32. A ball actuated rollover switch for a playfield of a pinball game, comprising a yieldable surface-defining member which is adapted to be supported with respect to the surface of the pinball game playfield and which defines the yieldable surface to be deformable between first and second shapes upon ball engagement with said member, thereby to provide a surface region which travels a detectable distance upon ball engagement with said member; said member including a plurality of hingedly-connected, relatively flat elements.

33. A ball actuable rollover switch for a playfield of a pinball game, comprising a yieldable surface-defining member which is adapted to be supported with respect to the surface of the pinball game playfield and which defines the yieldable surface to have a surface region movable between a first non-ball engaged position and a second ball engaged position, said second ball engaged position being substantially level with the playfield surface to thereby minimize ball deflection upon such engagement; said member including a plurality of hingedly-connected, relatively flat elements.

34. The rollover switch according to claims 32 or 33 and further including a detector disposed with respect to said member for detecting movement of said surface region.

35. The rollover switch according to claim 34 wherein said detector includes at least one switch contact.

36. A ball actuated rollover switch for a playfield of a pinball game, comprising a yieldable surface-defining member which is adapted to be supported with respect to the surface of the pinball game playfield and which defines the yieldable surface to be deformable between first and second shapes upon ball engagement with said member, thereby to provide a surface region which travels a detectable distance upon ball engagement with said member; said yieldable surface-defining means including a support and a plurality of members connected to the support to define said yieldable surface to taper towards the playfield surface.

37. A ball actuable rollover switch for a playfield of a pinball game, comprising a yieldable surface-defining member which is adapted to be supported with respect to the surface of the pinball game playfield and which defines the yieldable surface to have a surface region movable between a first non-ball engaged position to a second ball engaged position, said second ball engaged position being substantially level with the playfield surface to thereby minimize ball deflection upon such engagement; said yieldable surface-defining means including a support and a plurality of members connected to the support such that the first position defines said yieldable surface to taper towards the playfield surface.

38. The rollover switch according to claim 36 or 37 and including a detector disposed with respect to said member for detecting movement of said surface region.

39. A ball actuable rollover switch for a playfield of a pinball game comprising means adapted to be supported with respect to the surface of the pinball game playfield for defining a yieldable surface deformable to provide a surface region movable between a position not substantially level with the playfield surface and a position substantially level with the playfield surface; said yieldable surface-defining means comprising a support and a plurality of members connected to the support such that the non-level playfield position defines an overall surface which tapers therefrom toward the playfield surface.

40. The rollover switch according to claim 39 and including a set of switch contacts disposed with respect to said surface-defining means to be actuated thereby when the region moves between said positions due to ball engagement with the yieldable surface.

41. A ball rollover device for pinball game machine comprising:

(a) support structure adapted to be supported by the pinball game playfield;

(b) a plurality of surface-defining members extending outwardly from a central region to respective peripheral areas; and (c) means movably connecting the respective surface-defining members to said support structure at the peripheral areas; wherein said support structure, said surface-defining members, and said connecting means is unitary, whereby the plurality of surface-defining members are movable with respect to each other to define an overall elastic surface which is deformable to provide substantially flat and substantially pyramidal shapes.

42. A ball actuable rollover switch for a playfield of a pinball game comprising a plurality of members adapted to be supported with respect to the surface of the pinball game playfield for defining in combination a yieldable surface deformable to provide a surface region movable between a position not substantially level with the playfield surface and a position substantially level with the playfield surface.

43. The rollover switch according to claim 42 and including at least one switch contact disposed with respect to said plurality of members to be actuated thereby when the region moves between said positions due to ball engagement with the yieldable surface.

* * * * *

UNITED STATES PATENT OFFICE

CERTIFICATE OF CORRECTION

Patent No. 4,360,203 Dated November 23, 1982

Inventor(s) Roman F. Garbark

It is certified that error appears in the above-identified patent and that said Letters Patent are hereby corrected as shown below:

Column 4, line 57, change "yield-ability" to -- yieldability --.

Column 9, line 1 of claim 18, change "16" to -- 17 --; line 1 of claim 22, change "20" to -- 21 --; line 1 of claim 23, change "20" to -- 21 --; line 1 of claim 24, change "20" to -- 21 --; line 1 of claim 25, change "20" to -- 21 --; line 1 of claim 26, change "20" to -- 21 --; line 1 of claim 27, change "20" to -- 21 --.

Signed and Sealed this

*Twelfth* Day of *April 1983*

[SEAL]

*Attest:*

GERALD J. MOSSINGHOFF

*Attesting Officer*

*Commissioner of Patents and Trademarks*